US009227331B2

(12) United States Patent
Zhuk et al.

(10) Patent No.: US 9,227,331 B2
(45) Date of Patent: Jan. 5, 2016

(54) RAZOR BLADE UNIT

(71) Applicant: The Gillette Company, Boston, MA (US)

(72) Inventors: Andrew Vladimirovich Zhuk, Berlin, MA (US); Oliver Heinz Claus, Walpole, MA (US); Caleb MacCallum Estabrooks, Somerville, MA (US)

(73) Assignee: The Gillette Company, Boston, MA (US)

( * ) Notice: Subject to any disclaimer, the term of this patent is extended or adjusted under 35 U.S.C. 154(b) by 296 days.

(21) Appl. No.: 14/029,975

(22) Filed: Sep. 18, 2013

(65) Prior Publication Data

US 2014/0123497 A1 May 8, 2014

Related U.S. Application Data

(60) Provisional application No. 61/722,789, filed on Nov. 6, 2012.

(51) Int. Cl.

| | |
|---|---|
| ***B26B 21/54*** | (2006.01) |
| ***B26B 21/56*** | (2006.01) |
| ***B21D 53/64*** | (2006.01) |
| ***B26B 21/22*** | (2006.01) |

(52) U.S. Cl.

CPC ..... *B26B 21/565* (2013.01); *B21D 53/645* (2013.01); *B26B 21/22* (2013.01)

(58) Field of Classification Search

CPC ..... B26B 21/54; B26B 21/56; B26B 21/565; B26B 21/00; B21D 53/645

USPC ..... 30/49, 32; 76/104.1

See application file for complete search history.

(56) References Cited

U.S. PATENT DOCUMENTS 3,778,172 A * 12/1973 Myren ..... A46B 11/002 401/7
4,720,917 A 1/1988 Solow
4,754,548 A 7/1988 Solow
4,807,360 A 2/1989 Cerier et al.
4,875,288 A 10/1989 Trotta et al.
4,893,641 A * 1/1990 Strickland ..... B26B 21/40 128/898
4,964,214 A 10/1990 Welsh et al.
4,977,670 A 12/1990 Iten
5,031,317 A 7/1991 Jacobson
5,088,195 A 2/1992 Lazarchik et al.
5,199,173 A * 4/1993 Hegemann ..... B26B 21/165 30/49
5,208,982 A * 5/1993 Ferruzza, Jr. ..... B26B 21/28 30/49
5,293,768 A 3/1994 Lazarchik et al.
5,490,329 A 2/1996 Chylinski et al.
5,492,038 A 2/1996 Chylinski et al.
5,802,720 A * 9/1998 Pribe ..... B26B 21/00 30/32
5,979,056 A * 11/1999 Andrews ..... B26B 21/00 30/356
7,007,393 B2 3/2006 Guimont
7,730,619 B2 * 6/2010 Ozenick ..... B62B 21/222 30/49
2003/0213129 A1 11/2003 Nicolosi et al.
2004/0088863 A1 5/2004 Guimont
2012/0192432 A1 * 8/2012 Zane ..... B26B 21/28 30/50

FOREIGN PATENT DOCUMENTS

WO WO 88/05716 8/1988

* cited by examiner

*Primary Examiner* — Phong Nguyen

(74) *Attorney, Agent, or Firm* — Kevin C. Johnson; Steven W. Miller

(57) ABSTRACT

A razor blade unit including a housing having a top surface, and a loop disposed on the top surface, the loop having two terminal ends and two exposed opposing edges between the two terminal ends. The loop intersects the top surface at the two terminal ends and the two terminal ends are spaced apart from each other on the top surface. At least a portion of at least one of the two exposed opposing edges has a cutting edge. The razor blade unit provides improved conformity to skin contours.

17 Claims, 6 Drawing Sheets

RAZOR BLADE UNIT

FIELD OF THE INVENTION

The present invention relates to a razor blade unit. The present invention also relates to a razor comprising the razor blade unit, and a manufacturing process of making the razor blade unit.

BACKGROUND OF THE INVENTION

Flexible razors have evolved to address user needs during shaving, especially in improving conformity to skin contours. Such improved conformity to skin contours is desired particularly when trying to shave highly contoured surface areas of the body, e.g., legs, arms, armpits, and face. By contrast, lack of good conformity to skin contours must be compensated for by an application of shaver pressure to flatten the skin and force conformity, which on occasion causes cuts and abrasions.

The prior art includes various approaches to construct flexible razors. For instance, one approach is to use a plurality of individual blades that are connected to a handle by a resilient connecting means. Yet another approach is to mount a plurality of cutting elements on a flexible base material. Such, flexibility is provided by separate flexible carriers, e.g., the resilient connecting means which holds the individual blades, and the flexible base material on which the cutting elements are mounted, whereas either the blades or cutting elements per se are rigid. However, the rigidity of the blades or cutting elements limits the responsiveness and conformity to skin contours. Moreover, the requirement for a separate flexible carrier limits the diversity of razor designs, particularly cartridge and handle designs.

Thus, there is a need for a razor, in particular a razor blade unit, which provides improved conformity to skin contours.

It is an advantage of the present invention to provide a razor blade unit that shaves skin contours efficiently, e.g., an effective shaving for highly contoured surface areas of the body, less time-consuming during shaving, or one shaving stroke for wider surface areas of the body.

It is another advantage of the present invention to provide a razor blade unit that provides a comfortable and safe shaving experience to users.

It is yet another advantage of the present invention to provide a razor blade unit that is applicable to a wide variety of razor designs, particularly cartridge and handle designs, i.e., a flexible razor blade unit that does not require a separate flexible carrier.

It is a further advantage of the present invention to provide a razor blade unit that is easier to manufacture, e.g., having a relatively simple structure or less amounts of structural components.

SUMMARY OF THE INVENTION

In one aspect, the present invention is directed to a razor blade unit, comprising:

a) a housing comprising a top surface; and b) a loop disposed on the top surface, the loop comprising two terminal ends and two exposed opposing edges between the two terminal ends, wherein the loop intersects the top surface at the two terminal ends, wherein the two terminal ends are spaced apart from each other on the top surface, and wherein at least a portion of at least one of the two exposed opposing edges has a cutting edge.

Preferably, the present invention is directed to a razor blade unit, comprising:

a) a housing comprising a top surface; and b) a loop disposed on the top surface, the loop comprising two terminal ends and two exposed opposing edges between the two terminal ends, wherein the loop intersects the top surface at the two terminal ends, wherein the two terminal ends are spaced apart from each other on the top surface, and wherein at least a portion of at least one of the two exposed opposing edges has a cutting edge, wherein a plurality of the loops are connected to one another at their respective terminal ends via a plurality of spacers to form an integrated plurality of loops, wherein each loop of the plurality of loops is separated by a spacer of the plurality of spacers, and wherein the integrated plurality of loops is attached to the housing.

In another aspect, the present invention is directed to a razor comprising the razor blade unit.

In yet another aspect, the present invention is directed to a manufacturing process of making a razor blade unit, the process comprising the steps:

a) deforming a strip having a cutting edge to form an integrated plurality of loops; and b) disposing the integrated plurality of loops on a top surface of a housing.

In a further aspect, the present invention is directed to the use of a strip in making the razor blade unit, wherein the strip comprises a material selected from the group consisting of steel, polymer, ceramic, and a combination thereof.

DETAILED DESCRIPTION OF THE INVENTION

Definitions

Figure 1:
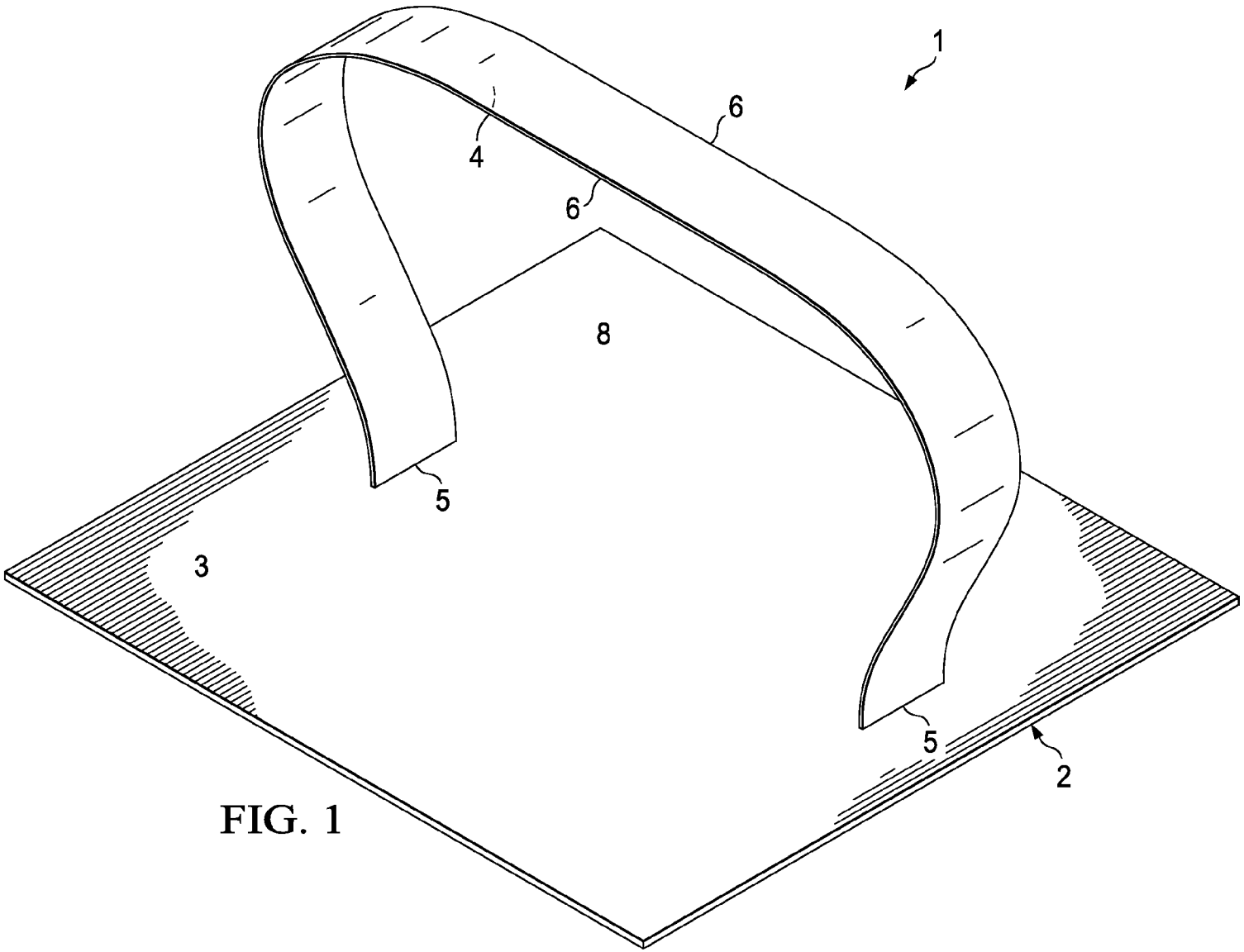
FIG. 1 is a perspective view of a razor blade unit according to one embodiment of the present invention.

As used herein, the term "razor" refers to a sharp-edged cutting instrument used especially for shaving surface areas of the body. Non-limiting examples include straight razors, disposable razors, and electric razors. A typical razor comprises a cutting element having a cutting edge and a housing on which the cutting element is disposed. The term "cutting edge" herein refers to the portion of a cutting element for cutting hairs from a target skin area.

As used herein, the term "loop" refers to a cutting element disposed on the top surface of a housing, wherein the loop comprises two terminal ends and two exposed opposing edges between the two terminal ends. The loop intersects the top surface at the two terminal ends, and the two terminal ends of one loop are spaced from each other on the top surface of the housing. Typically, the loop is shaped from a strip. The term "strip" herein means a piece, typically a narrow thin piece of material of uniform width. The material is typically one capable of having a cutting edge. When shaped to a loop, the strip forms either a single loop or an integrated plurality of loops. In a single loop execution, the two long edges of the strip typically form the two exposed opposing edges of the loop, and the two short edges of the strip typically form the two terminal ends of the loop as to where the loop intersects the top surface of the housing. The two exposed opposing edges may or may not be parallel to each other. The term "expose" herein means being accessible to shaving hairs from a target skin area without obstruction when the loop is disposed on the top surface of the housing. The term "intersect" herein refers to two configurations having one or more points in common.

As used herein, the term "shaving load" refers to the typical force which is generated between the razor and the skin when shaving. The term "shaving surface" herein refers to the surface comprising skin and hairs, where the razor and skin interact to generate the shaving load.

As used herein, the terms "flexible" and "flexibility" refer to being capable of bending or deforming when an external force on the scale of shaving loads is applied. The terms "rigid" and "rigidity", as used herein, refer to not being capable of flexibility. The terms "conform" and "conformity", as used herein, refers to a razor, a razor blade unit, or a cutting element, which is capable of flexibility and therefore deforms in compliance with skin contours when shaving loads are applied. The terms "sharp" and "sharpness", as used herein, refer to being capable of cutting a subject, e.g., via a cutting edge.

As used herein, the term "concave" refers to a surface that curves inward, as the interior of a sphere, and the term "convex" refers to a surface that curves outward, as the exterior of a sphere.

As used herein, the terms "comprise", "comprises", "comprising", "include", "includes", "including", "contain", "contains", and "containing" are meant to be non-limiting, i.e., other steps and other ingredients which do not affect the end of result can be added. The above terms encompass the terms "consisting of" and "consisting essentially of"

As used herein, the articles including "a" and "an" when used in a claim are understood to mean one or more of what is claimed or described.

Razor Blade Unit

The razor blade unit 1 of the present invention comprises a loop 4. Referring now to FIG. 1, there is shown a preferred embodiment of the loop 4 of the present invention. The loop 4 comprises two terminal ends 5 and two exposed opposing edges 6 between the two terminal ends 5, wherein the loop 4 intersects the top surface 3 at the two terminal ends 5, wherein the two terminal ends 5 are spaced apart from each other on the top surface 3, and wherein at least a portion of at least one of the two exposed opposing edges 6 has a cutting edge. The two terminal ends 5 spaced apart from each other on the top surface 3 render the loop 4 unclosed. The points where either side of the loop 4 first contact the top surface 3 (in a non-channel execution), with the shortest linear distance there between, are considered the terminal ends 5 of the loop 4.

Different from the rigid blade or cutting element in the prior art, the loop 4 has a structure that is self-supporting and flexible, thus providing improved conformity to skin contours. Moreover, the improved conformity to skin contours leads to a more effective and efficient shaving, especially for highly contoured surface areas of the body. Furthermore, the self-supporting and flexible loop 4, whilst not requiring a separate flexible carrier, allows for the use of a wide variety of razor designs, particularly cartridge and handle designs.

The loop 4 herein, in a non-compressed state, defines a hole 8 which can be of any geometric shape, e.g., triangular, rectangular, trapezoidal, pentagonal, hexagonal, oval, round, or semi-circled. Preferably, the hole 8, in a non-compressed state, is substantially an oval as shown in FIG. 1. The hole 8 has a cross sectional area of from about 1 $mm^2$ to about 400 $mm^2$, preferably from about 5 $mm^2$ to about 200 $mm^2$, more preferably from about 10 $mm^2$ to about 100 $mm^2$ In a preferred embodiment, the hole 8 is substantially an oval and has a cross sectional area of from about 1 $mm^2$ to about 400 $mm^2$.

The loop 4 herein can have any suitable width and circumferential length. The term "circumferential length" herein refers to the distance measured circumferentially between the two terminal ends 5 of the loop 4 as the two exposed opposing edges 6 of the loop 4 expose out of the top surface 3. The term "width" herein refers to the distance between the two exposed opposing edges 6 of the loop 4 perpendicular to the circumferential length. The width of the loop 4 is typically dimensionally less than the circumferential length of the loop 4. The loop 4 may have a circumferential length of from about 1 mm to about 50 mm, preferably from about 5 mm to about 20 mm. The loop 4 may have a width of from about 0.1 mm to about 10 mm, preferably from about 0.2 mm to about 2 mm. Additionally, the width of the loop 4 does not need to be uniform along the exposed opposing edges 6. In such an event, an average width can be measured.

Material forming the loop 4 herein can be of any suitable thickness. Preferably, the material forming the loop 4 has a thickness that enables improved flexibility and conformity to skin contours. In one embodiment, the material forming the loop 4 has a thickness, in a non-cutting edged portion, of from about 1 micron to about 200 microns, preferably from about 10 microns to about 50 microns, more preferably from about 10 microns to about 30 microns.

The loop 4 herein can comprise any suitable materials, e.g., metal, plastic. In one embodiment, the loop 4 comprises a material selected from the group consisting of steel, polymer, ceramic, and a combination thereof. Non-limiting examples of a polymer include: polycarbonate, polyethylene, and polypropylene. In a preferred embodiment, the material forming the loop 4 comprises steel, preferably stainless steel. More preferably, the material forming the loop 4 comprises steel having a thickness, in a non-cutting edged portion, of from about 5 microns to 20 microns, preferably about 10 microns. In an alternative embodiment, the material forming the loop 4 comprises polymer. More preferably, the material forming the loop 4 comprises polymer, in a non-cutting edged portion, having a thickness of from about 30 microns to about 100 microns, preferably about 80 microns.

The razor blade unit 1 of the present invention may comprise either a single loop 4, as shown in FIG. 1, or a plurality of loops 7, as shown in FIG. 2A, FIG. 2B, FIG. 3A, and FIG. 3B. Preferably, the razor blade unit 1 comprises a plurality of loops 7. In such an event, the plurality of loops 7 is arranged on the top surface 3 of the housing 2 with a suitable density. Preferably, the top surface 3 comprises from about 1 to about 50 loops in a 100 $mm^2$ surface area. In one embodiment, the plurality of loops 7 is arranged randomly. Alternatively, the plurality of loops 7 is arranged in certain patterns, e.g., a linear pattern 9, a non-linear pattern 11. Such a plurality of loops 7 provides a further improvement in conformity to skin contours as each individual loop 4 has the flexibility to conform to local skin contours when shaving loads are applied, unconstrained by the rest of loops in the plurality of loops 7. Moreover, the lines of contact pressure that exist with the blades in the prior art, e.g., a linear blade, are removed and replaced by a plurality of smaller points of contact pressure, thereby achieving more precision in conformity to local skin contours. This precision further leads to a much more efficient shaving as well as a comfortable and safe shaving experience.

Figure 2A:
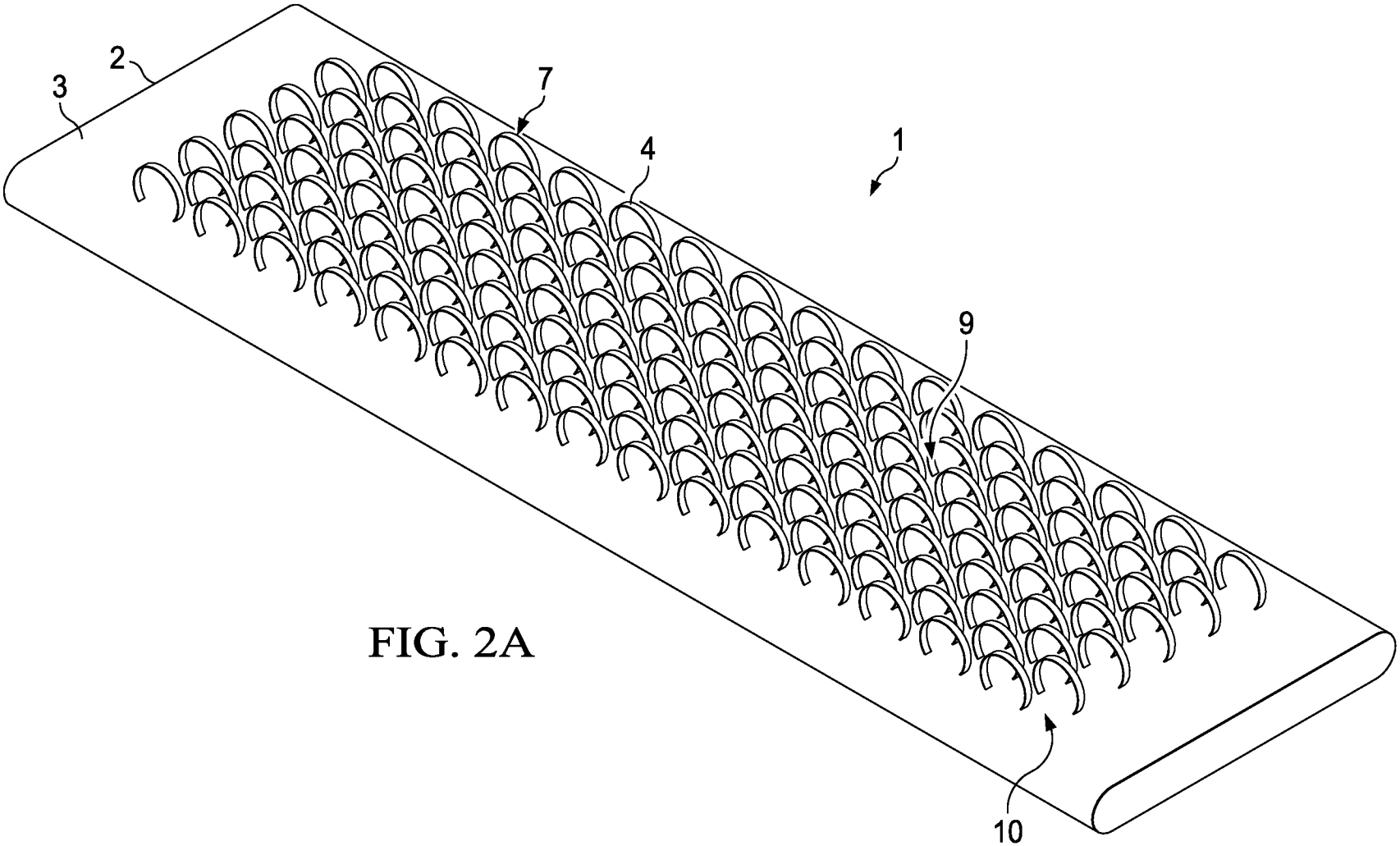
FIG. 2A is a perspective view of a razor blade unit according to one preferred embodiment of the present invention.
Figure 2B:
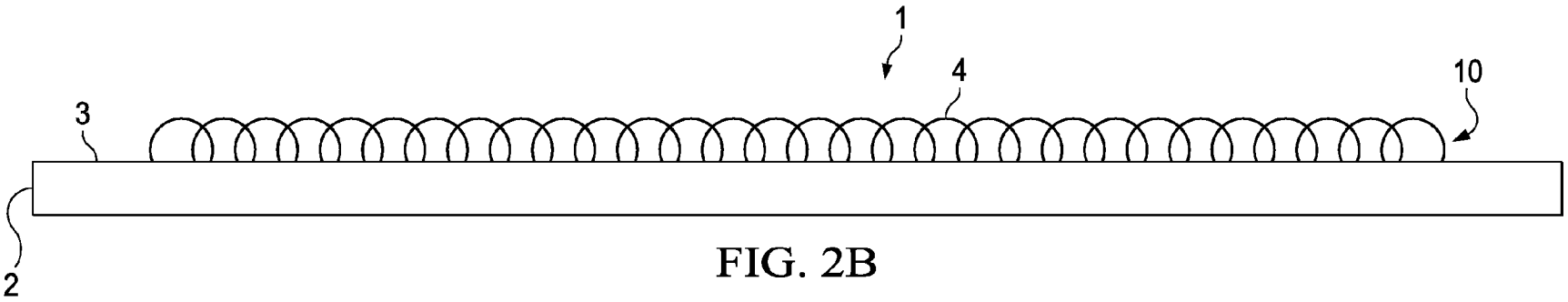
FIG. 2B is a side view of the razor blade unit in FIG. 2A.

Preferably, the plurality of loops 7 is arranged in linear patterns 9 to form one or more rows of loops 10. FIG. 2A and FIG. 2B show preferred embodiments of the razor blade unit 1 of the present invention, which comprise a plurality of loops 7 arranged in linear patterns 9 to form several rows of loops 10. In terms of the number of the loops in each row of loops 10, preferably each row of loops 10 comprises at least about 2 of the loops 4, more preferably from about 5 to about 200, even more preferably from about 10 to about 80, yet even more preferably from about 15 to about 50. In terms of the number of the rows of loops 10, the razor blade unit 1 herein comprises at least about 1, preferably from about 1 to about 50, more preferably from about 2 to about 30, even more preferably from about 3 to about 15 of the rows of loops 10. More preferably, the loops 4 in alternate rows are staggered relative to one another. Even more preferably, the loops 4 in alternate rows are half period shifted to one another, as shown in FIG. 2A and FIG. 2B. The plurality of loops 7 in each row of loops 10 may be either disconnected, or connected to each other, i.e., forming an integrated row of loops.

Figure 3A:
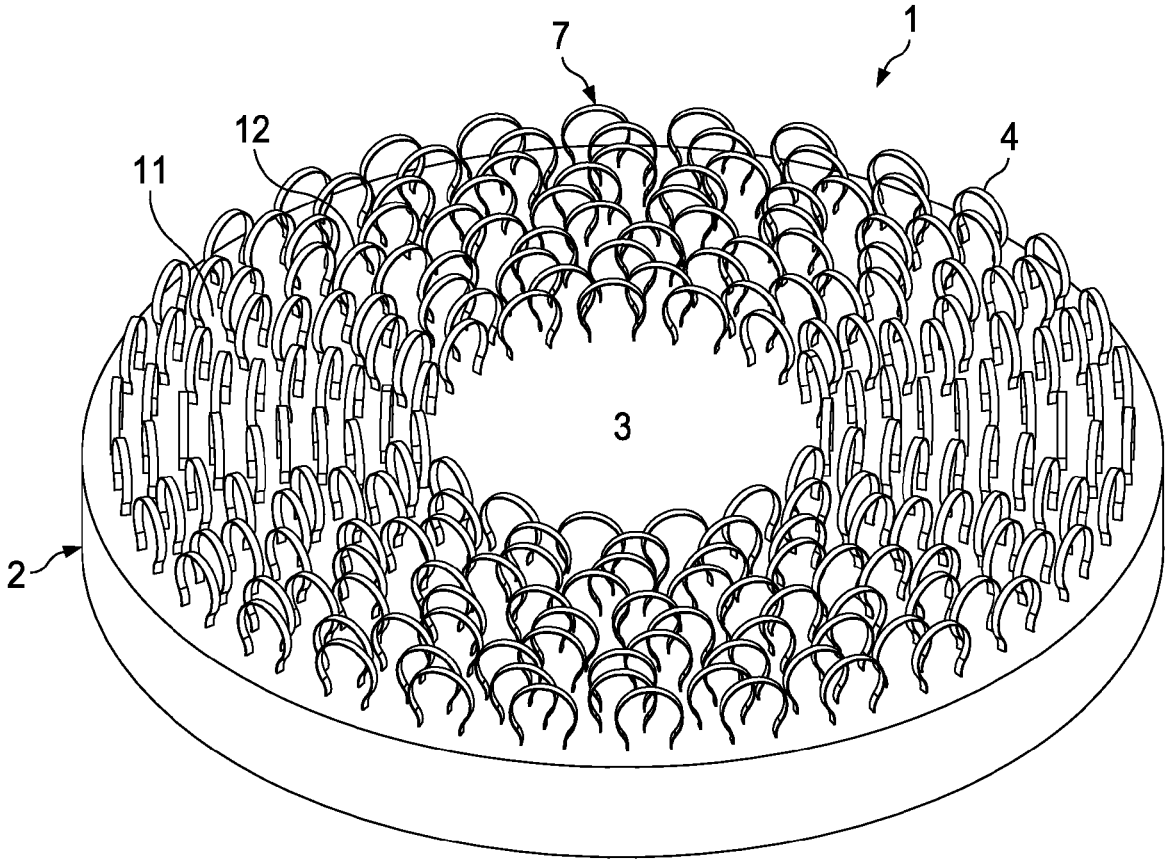
FIG. 3A is a perspective view of a razor blade unit according to an alternative embodiment of the present invention.
Figure 3B:
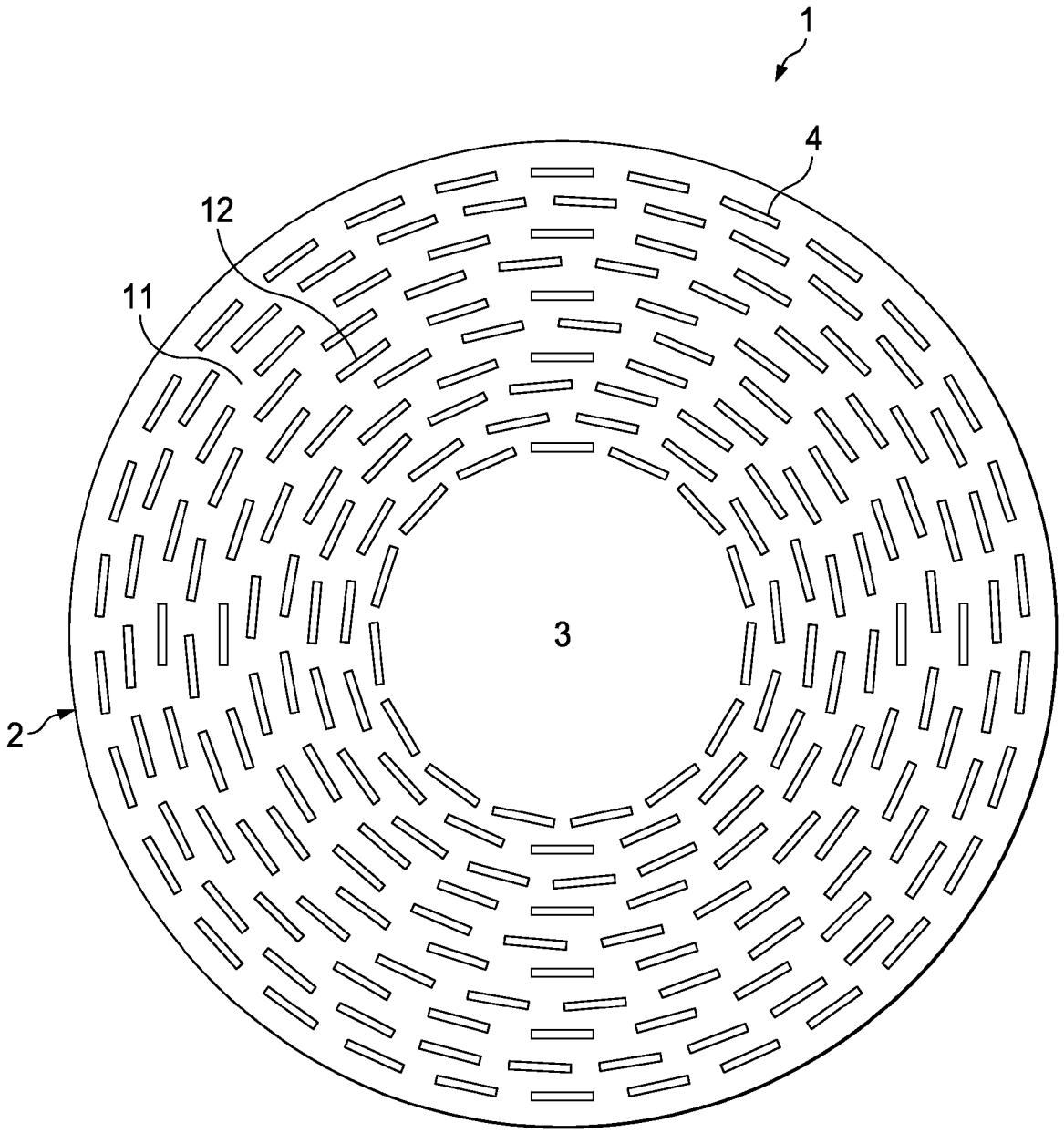
FIG. 3B is a top view of the razor blade unit in FIG. 3A.

Alternatively, the plurality of loops 7 is arranged in a non-linear pattern 11. The plurality of loops 7 may be arranged in a non-linear pattern 11 selected from the group consisting of a circular pattern, oval pattern, triangular pattern, rectangular pattern, trapezoidal pattern, pentagonal pattern, hexagonal pattern, and a combination thereof. Preferably, the plurality of loops 7 is arranged in a circular pattern having one or more rings of loops 12, as shown in FIG. 3A and FIG. 3B. More preferably, the plurality of loops 7 is arranged in a circular pattern having from about 3 to about 20 rings of loops 12, preferably from about 3 to about 15 rings of loops 12, more preferably from about 5 to about 10 rings of loops 12. Each ring of loops 12 may comprise any suitable number of the loops 4, e.g., from about 5 to about 300 of the loops 4. Preferably, in the same circular pattern, the outer ring of loops comprises more loops than the inner ring of loops. The plurality of loops 7 in each ring may be either disconnected, or connected to each other, i.e., forming an integrated ring of loops.

The loop 4 herein can be disposed on the top surface 3 of the housing 2, via any attachment means known to the person skilled in the art, so that the two exposed opposing edges 6 expose out of the top surface 3. For example, the loop 4 can be mounted on the top surface 3, fastened with a filament to the top surface 3, inserted into the top surface 3, welded, glued, or molded to the top surface 3, or otherwise mechanically or chemically attached to the top surface 3. In one embodiment, the attachment means of disposing the loop 4 on the top surface 3 of the housing 2 need not be associated with the top surface 3, but rather can be associated with a front wall, a rear wall, or a side wall of the housing 2. In another embodiment, the two terminal ends 5 of the loop 4 are attached to the top surface 3. For example, the razor blade unit 1 comprises a single loop 4, wherein the two terminal ends 5 of the single loop 4 are attached to the top surface 3, or the razor blade unit 1 comprises a plurality of loops 7 that are disconnected or non-integrated from each other, wherein the two terminal ends 5 of each loop 4 of the plurality of loops 7 are attached to the top surface 3.

Figure 4:
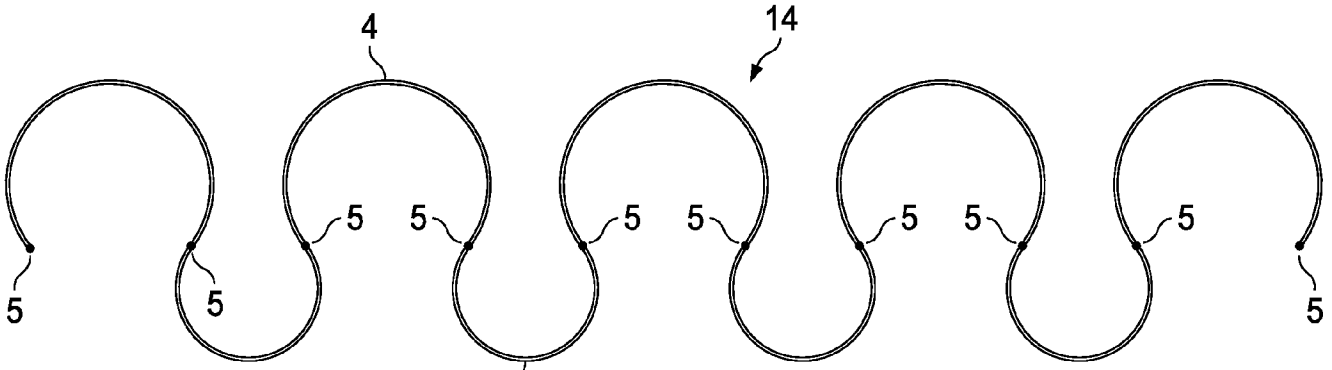
FIG. 4 is a side view of an integrated plurality of loops according to one preferred embodiment of the present invention.

Preferably, the razor blade unit 1 herein comprises a plurality of loops 7, wherein the plurality of loops 7 are connected to one another at their respective terminal ends 5 via a plurality of spacers to form an integrated plurality of loops 14, wherein each loop 4 of the plurality of loops 14 is separated by a spacer 13 of the plurality of spacers, as shown in FIG. 4. Alternatively, the razor blade unit 1 herein comprises a plurality of loops 7, wherein the plurality of loops 7 are connected to one another at their respective terminal ends 5 directly. The integrated plurality of loops 14 is disposed on, preferably attached to, more preferably mounted on the top surface 3 of the housing 2. Such an integrated plurality of loops 14 has a relatively simple structure and does not contain separate structural components, thus being easier to manufacture and to dispose on the housing 2.

The spacer 13 used for connecting the two adjacent loops can be of any suitable shape, e.g., linear, triangular, rectangular, trapezoidal, pentagonal, hexagonal, oval, round, semicircled, or arced. Preferably, the spacer 13 has an inverse loop shape. More preferably, the loop 4 defines a hole 8 that is substantially an oval, and the spacer 13 has an inverse loop shape, thus forming a sinusoidal-shaped integrated plurality of loops 14, as shown in FIG. 4. The spacer 13 may be on or below the top surface 3, or into the housing 2. For example, the spacer 13 is a linear line attached to the top surface 3, or the spacer 13 has an inverse loop shape below the top surface 3.

Figure 5:
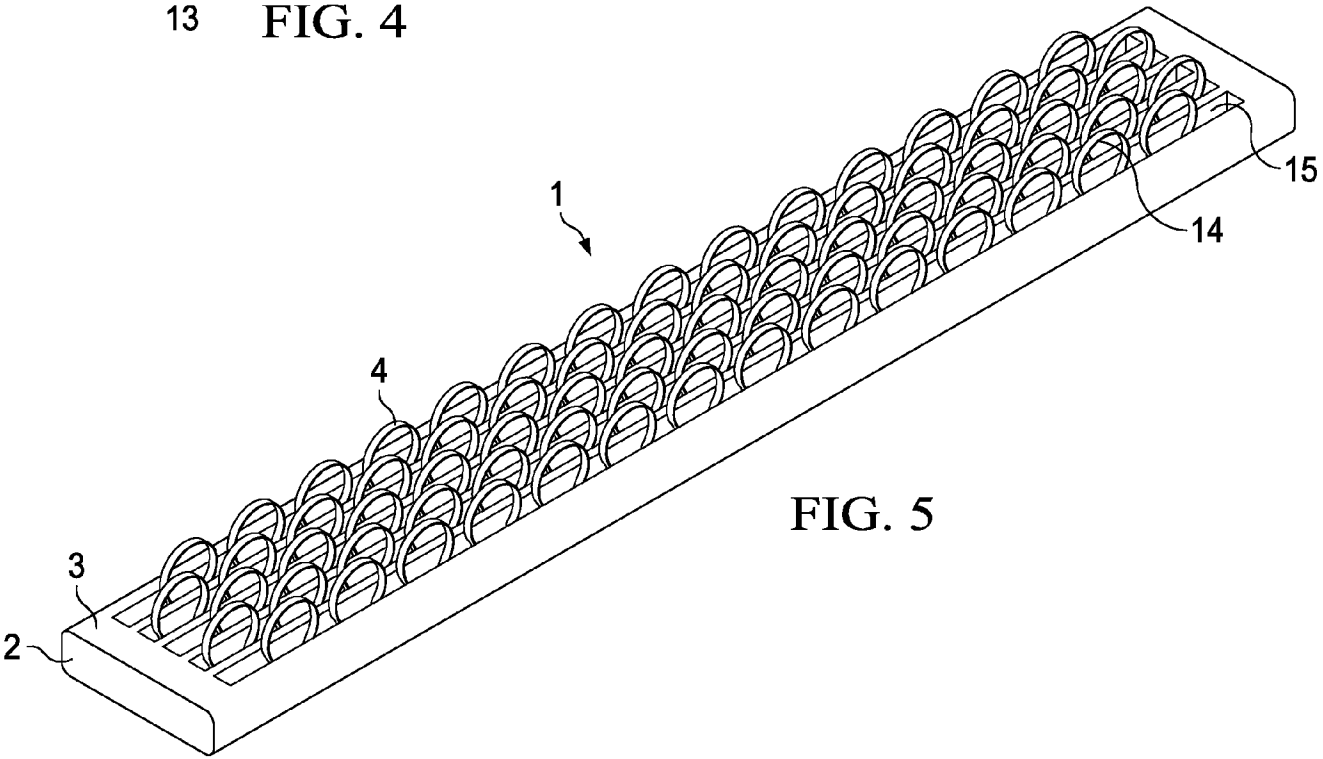
FIG. 5 is a perspective view of a razor blade unit according to another preferred embodiment of the present invention.

FIG. 5 shows a preferred embodiment of the razor blade unit 1 of the present invention, wherein the housing 2 comprises a channel 15 below the top surface 3, and wherein at least a portion of the plurality of spacers is contained in the channel 15. Preferably, the entire portion of the spacers 13 is contained in the channel 15. More preferably, the integrated plurality of loops 14 is a sinusoidal-shaped integrated plurality of loops 14, wherein the spacers 13 having an inverse loop shape are contained in the channel 15. Without wishing to be bound by theory, the channel 15 of the housing 2 helps in affixing a portion of the integrated plurality of loops 14 to the housing 2, thereby achieving a controlled and desirable motion of the loop 4 when shaving loads are applied. Furthermore, with the channel 15, the loop 4 does not deform significantly during shaving, thus ensuring a continued flexibility.

In a channel execution, a channel median axis is defined as the intersection line between a vertical channel plane emitting from the center and along the channel 15 (i.e., channel length) and a horizontal plane emitting from either side of the top surface 3 defining the outer and upper most boundary of the channel 15 (i.e., channel width). The vertical channel plane is typically normal to the horizontal plane. The points where the loop 4 intersects the top surface 3 to define the terminal ends 5 of the loop 4, are defined as the intersection points where the loop 4 intersects the channel median axis of the channel 15 in which the spacer 13 connecting the loop 4 is contained.

The razor blade unit 1 herein can comprise one or more groups of the integrated plurality of loops 14. The groups of the integrated plurality of loops 14 can be arranged randomly or in certain patterns, e.g., a linear pattern, a non-linear pattern. The non-linear pattern herein is selected from the group consisting of a circular pattern, oval pattern, triangular pattern, rectangular pattern, trapezoidal pattern, pentagonal pattern, hexagonal pattern, and a combination thereof. In one embodiment, two or more integrated rows of loops 10 form one group of the integrated plurality of loops 14. In another embodiment, two or more integrated rings of loops 12 arranged in a circular pattern form one group of the integrated plurality of loops 14. In yet another embodiment, the razor blade unit 1 comprises two groups of the integrated plurality of loops 14, wherein one group comprises two or more integrated rows of loops 10 and the other groups comprises two or more integrated rings of loops 12 arranged in a circular pattern.

At least a portion of at least one of the two exposed opposing edges 6 has a cutting edge, i.e., either a portion or the entire exposed length of at least one of the two opposing edges 6 has a cutting edge. In one embodiment, at least a portion of one of the two exposed opposing edges 6 has a cutting edge. Preferably, at least a portion of each of the two exposed opposing edges 6 has a cutting edge. More preferably, each of the two exposed opposing edges 6 has a cutting edge. This arrangement allows for an effective shaving when the loop 4 moves back and forth in the plane of shaving surface.

The cutting edge of the razor blade unit 1 herein may be either a two-dimensional or three-dimensional surface. In one embodiment, the cutting edge is a two-dimensional surface, e.g., the razor blade unit 1 comprises loops having holes 8 of the same cross sectional area. Alternatively, the cutting edge is a three-dimensional surface, wherein the loops 4 have holes 8 of different cross sectional areas so as to form a three-dimensional surface of cutting edges, i.e., the tangents of the cutting edges of the loops 4 form a three-dimensional surface as a whole. In addition to the loops 4 having holes 8 of different cross sectional areas, the three-dimensional surface of cutting edges may also be rendered by a housing 2 having a three-dimensional top surface topology, e.g., a housing 2 having a convex or concave top surface 3. Such a three-dimensional surface of cutting edges provides a more effective shaving to highly contoured surface areas of the body, e.g., armpits.

In a highly preferred embodiment, as shown in FIG. 2A, the razor blade unit 1 of the present invention comprises a plurality of loops 7 to form 10 integrated rows of loops 10, wherein each integrated row of loops 10 comprises 15 loops 4 and is sinusoidal-shaped, wherein the loops 4 in alternate rows are half period shifted to one another, and wherein material forming the loop 4 comprises stainless steel having a thickness, in a non-cutting edged portion, of 10 microns.

In another highly preferred embodiment, as shown in FIG. 3A, the razor blade unit 1 of the present invention comprises a plurality of loops 7 arranged in a circular pattern having 10 integrated rings of loops 12, wherein each integrated ring of loops 12 is sinusoidal-shaped, and wherein material forming the loop 4 comprises stainless steel having a thickness, in a non-cutting edged portion, of 10 microns.

The loop 4 of the present invention is rendered flexible as well as sharp, due to its structure, material, arrangements, etc. In one embodiment, when shaving loads are applied, the cutting edge of the loop 4 is configured to respond to the shaving loads by deflecting from a plane that is normal to the shaving surface within an appropriate angle, preferably within an angle of from about 0 degree to about 30 degrees. In another preferred embodiment, the cutting edge of the loop 4, in a non-compressed state, is configured to have an appropriate angle to a shaving surface, preferably have an angle of from about 0 degree to about 30 degrees to a shaving surface.

The razor blade unit 1 of the present invention comprises a housing 2 comprising a top surface 3 on which the loop 4 is disposed. A wide variety of conventional housings 2 is suitable for use herein, e.g., a molded frame. The housing 2 may comprise a front wall, a rear wall, and two opposing side walls disposed transverse to and between the front wall and the rear wall.

The top surface 3 of the housing 2 may or may not be substantially flat. The housing 2 may comprise a concave top surface or a convex top surface. In one embodiment, the top surface 3 comprises a surface area of from about 300 $mm^2$ to about 3000 $mm^2$, preferably from about 400 $mm^2$ to about 1500 $mm^2$ The top surface 3 of the housing 2 herein can be of any suitable shape. The shape of the top surface 3 may be selected from the group consisting of round, oval, triangular, rectangular, trapezoidal, pentagonal, hexagonal, and a combination thereof. Preferably, the shape of the top surface 3 is oval, rectangular, or rectangular with rounded corners. Typically, the shape of the housing 2 is designed depending on the arrangements of the loops 4, particularly the patterns of the plurality of loops 7. In a preferred embodiment, as shown in FIG. 2A, the housing 2 comprises a rectangular top surface 3 on which linear patterns 9 of loops 4 (i.e., several rows of loops 10) are disposed. In an alternative embodiment, as shown in FIG. 3A, the housing 2 comprises a round top surface 3 on which a circular pattern of loops 4 is disposed.

The housing 2 herein can comprise any suitable materials known to the person skilled in the art. Preferably, the housing 2 comprises thermoplastic elastomers (TPEs). More preferably, the housing 2 comprises a material selected from the group consisting of silicone, natural rubber, butyl rubber, nitrile rubber, styrene butadiene rubber, styrene butadiene, styrene butadiene styrene (SBS) TPEs, styrene ethylene butadiene styrene (SEBS) TPEs. In conjunction with the loop 4, such housing 2 made of thermoplastic elastomers (TPEs) enhances the flexibility and conformity to skin contours.

Razor

One aspect of the present invention is directed to a razor comprising the razor blade unit 1. The razor herein preferably comprises a cartridge that holds the housing 2 and a handle connected to the cartridge.

The razor herein can be of any razor design known to the person skilled in the prior art. Preferably, the razor is designed as refillable so that it accepts new razor blade units 1 or comprises a disposable cartridge that is intended to be thrown away after the loop 4 therein has become dull.

The cartridge herein can be of any design known to the person skilled in the art. Typically, the cartridge is designed depending on the design of the housing 2 that the cartridge holds. For example, a flat cartridge comprises a housing 2 having a flat top surface, while a convex cartridge comprises a housing 2 having a convex top surface. Other examples include: a rectangular cartridge comprises a housing 2 having a rectangular top surface on which linear patterns 9 of loops 4 are disposed, or a round cartridge comprises a housing 2 having a round top surface on which a circular pattern of loops 4 is disposed. Furthermore, the cartridge typically comprises a surface area the same or slightly larger than the top surface 3 of the housing 2.

Preferably, the cartridge herein comprises a guard located ahead of the razor blade unit 1 and a cap located after the razor blade unit 1. More preferably, the guard is disposed on the front wall of the housing 2, and the cap is disposed on the rear wall of the housing 2.

The handle herein can be of any design known to the person skilled in the prior art. The handle may be integrated with the cartridge or connected to the cartridge via any connecting means known to the person skilled in the art. In one embodiment, the cartridge is mounted on the handle with the intention that the entire razor should be discarded when the loop 4 therein has become dull. Alternatively, the cartridge is detachably mounted on the handle so that the cartridge may be replaced by a new one when the loop 4 therein has lost the sharpness required for efficient shaving. Preferably, the handle comprises a proximate end and a distal end, wherein the proximate end comprises a tank, and the cartridge comprises a hood, wherein the tank is able to be inserted into the hood, thus connecting the cartridge with the handle.

Manufacturing Process

The razor blade unit 1 of the present invention is generally manufactured by conventional processes known to the person skilled in the prior art. A further aspect of the present invention is directed to a manufacturing process of making a razor blade unit 1 comprising an integrated plurality of loops 14, the process comprising the steps:

a) deforming a strip having a cutting edge to form the integrated plurality of loops 14; and b) disposing the integrated plurality of loops 14 on a top surface 3 of a housing 2.

In step b), the integrated plurality of loops 14 is disposed on the top surface 3 of the housing 2 so as to expose the cutting edge of the strip. Preferably, the integrated plurality of loops 14 is attached to the top surface 3 of the housing 2.

The manufacturing process of making the razor blade unit 1 comprising the integrated plurality of loops 14 according to the present invention requires simplified steps and therefore achieves higher production efficiency. In one embodiment, the manufacturing process herein is used to make any one of the aforementioned razor or razor blade unit 1 embodiments.

The strip herein has one or more cutting edges. In one embodiment, the strip has a cutting edge in one of the two long edges thereof, i.e., either a portion or the entire length of one of the two long edges has a cutting edge. Preferably, the strip has two cutting edges, e.g., each of the two long edges of the strip has a cutting edge.

The strip herein comprises the same material as the loop. Preferably, the strip comprises a material selected from the group consisting of steel, polymer, ceramic, and a combination thereof. In one embodiment, the strip is a stainless steel strip having a thickness, in a non-cutting edged portion, of from about 5 microns to about 20 microns, preferably about 10 microns. In an alternative embodiment, the strip is a polymer strip having a thickness, in a non-cutting edged portion, of from about 30 microns to about 100 microns, preferably about 80 microns.

Use of the Strip

One aspect of the present invention is directed to the use of a strip in making the razor blade unit 1. The strip comprises a material selected from the group consisting of steel, polymer, ceramic, and a combination thereof. Preferably, the strip is a steel strip or a polymer strip. In one embodiment, the use of the strip comprises using a stainless steel strip having a thickness, in a non-cutting edged portion, of from about 5 microns to about 20 microns, preferably about 10 microns. In an alternative embodiment, the use of the strip comprises using a polymer strip having a thickness, in a non-cutting edged portion, of from about 30 microns to about 100 microns, preferably about 80 microns.

Unless otherwise indicated, all percentages, ratios, and proportions are calculated based on weight of the total composition. All temperatures are in degrees Celsius (° C.) unless otherwise indicated. All measurements made are at 25° C., unless otherwise designated. All component or composition levels are in reference to the active level of that component or composition, and are exclusive of impurities, for example, residual solvents or by-products, which may be present in commercially available sources.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A razor blade unit comprising:

a) a housing comprising a top surface; and b) a plurality of loops disposed on said top surface, each loop comprising two terminal ends and two exposed opposing edges extending between said two terminal ends, wherein each loop intersects said top surface at said two terminal ends, wherein said two terminal ends are spaced apart from each other on said top surface, wherein at least a portion of one of said two exposed opposing edges has a cutting edge, and wherein the plurality of loops are connected to one another at their respective terminal ends via a plurality of spacers to form an integrated plurality of loops, wherein each loop of said integrated plurality of loops is separated by a spacer of said plurality of spacers, and wherein said integrated plurality of loops is attached to said housing.

2. The razor blade unit according to claim 1, wherein material forming said loop has a thickness, in a non-cutting edged portion, of from about 1 micron to about 200 microns and comprises a material selected from the group consisting of steel, polymer, ceramic, and a combination thereof.

3. The razor blade unit according to claim 2, wherein material forming said loop comprises steel having a thickness, in a non-cutting edged portion, of from about 5 microns to about 20 microns, or material forming said loop comprises polymer having a thickness, in a non-cutting edged portion, of from about 30 microns to about 100 microns.

4. The razor blade unit according to claim 1, wherein said loop, in a non-compressed state, defines a hole, wherein said hole is substantially an oval and has a cross sectional area of from about 1 $mm^2$ to about 400 $mm^2$.

5. The razor blade unit according to claim 1, wherein said top surface comprises from about 1 to about 50 loops in a 100 $mm^2$ surface area.

6. The razor blade according to claim 1, wherein when shaving loads are applied, said cutting edge is configured to respond to said shaving loads by deflecting from a plane that is normal to the shaving surface within an angle of from about 0 degree to about 30 degrees.

7. The razor blade unit according to claim 1, wherein said cutting edge, in a non-compressed state, is configured to have an angle of from about 0 degree to about 30 degrees to a shaving surface.

8. The razor blade unit according to claim 7, wherein the plurality of said loops is arranged in a non-linear pattern selected from the group consisting of a circular pattern, oval pattern, triangular pattern, rectangular pattern, trapezoidal pattern, pentagonal pattern, hexagonal pattern, and a combination thereof.

9. The razor blade unit according to claim 1, wherein the plurality of said loops is arranged in linear patterns to form from about 1 to about 50 rows of loops, and wherein each of said rows of loops comprises from about 5 to about 200 of said loops.

10. The razor blade unit according to claim 9, wherein said loops in alternate rows are staggered relative to one another.

11. The razor blade unit according to claim 1, wherein each of said two exposed opposing edges has a cutting edge.

12. The razor blade according to claim 1, wherein said loops have holes of different cross sectional areas so as to form a three-dimensional surface of cutting edges.

13. The razor blade unit according to claim 1, wherein said two terminal ends of said loop are attached to said top surface.

14. The razor blade unit according to claim 1, wherein said spacer has an inverse loop shape.

15. The razor blade unit according to claim 14, comprising one or more groups of said integrated plurality of loops.

16. The razor blade unit according to claim 15, wherein said housing comprises a channel below said top surface, and wherein at least a portion of said plurality of spacers is contained in said channel.

17. A razor comprising the razor blade unit according to claim 1.

* * * * *